United States Patent [19]

Ullal et al.

[11] Patent Number: 4,982,883

[45] Date of Patent: Jan. 8, 1991

[54] SKI AND POLE CARRIER

[76] Inventors: Pramode N. Ullal, P.O. Box 1827, Aptos, Calif. 95001-1827; Frederick F. Kazmierczak, 1463 Menorea Ct., San Jose, Calif. 95120

[21] Appl. No.: 402,481

[22] Filed: Sep. 1, 1989

[51] Int. Cl.[5] ..... A45F 3/04

[52] U.S. Cl. ..... 224/209; 224/917; 224/907; 224/214; 224/224

[58] Field of Search ..... 224/202, 209, 214, 224, 224/226, 227, 242, 917, 250, 257, 258, 259, 210, 907; 294/146, 147

[56] References Cited

U.S. PATENT DOCUMENTS

| | | | |
|---|---|---|---|
| 4,308,982 | 1/1982 | Hall | 224/917 X |
| 4,518,107 | 5/1985 | Amos | 224/224 |
| 4,673,118 | 6/1987 | Kronz | 224/917 X |
| 4,693,402 | 9/1987 | Comeau | 224/907 X |
| 4,819,845 | 4/1989 | Byrd | 224/917 X |
| 4,863,083 | 9/1989 | Chen | 224/226 |

FOREIGN PATENT DOCUMENTS

| | | | |
|---|---|---|---|
| 2214104 | 9/1973 | Fed. Rep. of Germany | 224/917 X |
| 2754061 | 6/1979 | Fed. Rep. of Germany | 224/907 X |
| 816256 | 8/1937 | France | 224/917 X |
| 209479 | 4/1940 | Switzerland | 224/917 X |

*Primary Examiner*—Henry J. Recla
*Assistant Examiner*—Glenn T. Barrett
*Attorney, Agent, or Firm*—Robert Buckley

[57] ABSTRACT

A fanny-pack with a shoulder harness allowing a skier to securely, comfortably, and with hands free, carry and transport, to and from ski lifts, skis, poles, and ski accessories. The basic ski carrier comprises a carrier worn around the waist and below the small of the back in combination with a shoulder harness assembly. The skis and poles are mounted rigidly to a locator on the carrier and secured at the top via a quick release strap on the shoulder harness. The entire carrier is lifted, secured around the waist, and the shoulder straps slipped on and adjusted. In this configuration the skis and poles are positioned at a precise angle safely away from making contact with the skier's head and legs while standing or walking. In the preferred embodiment the personal ski carrier is combined with pockets on either side to facilitate carrying essential ski accessories such as goggles, gloves, etc.

3 Claims, 4 Drawing Sheets

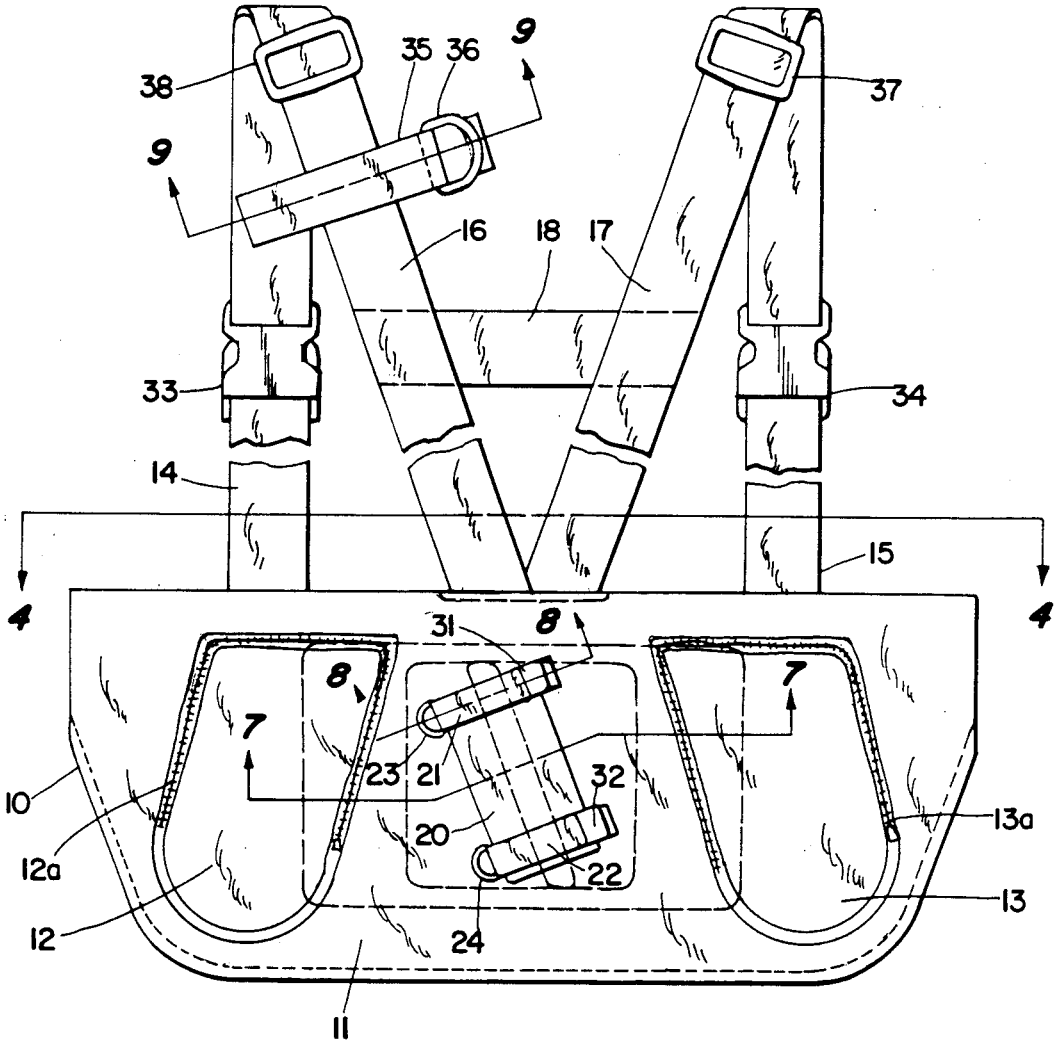
Fig. 3
Fig. 4
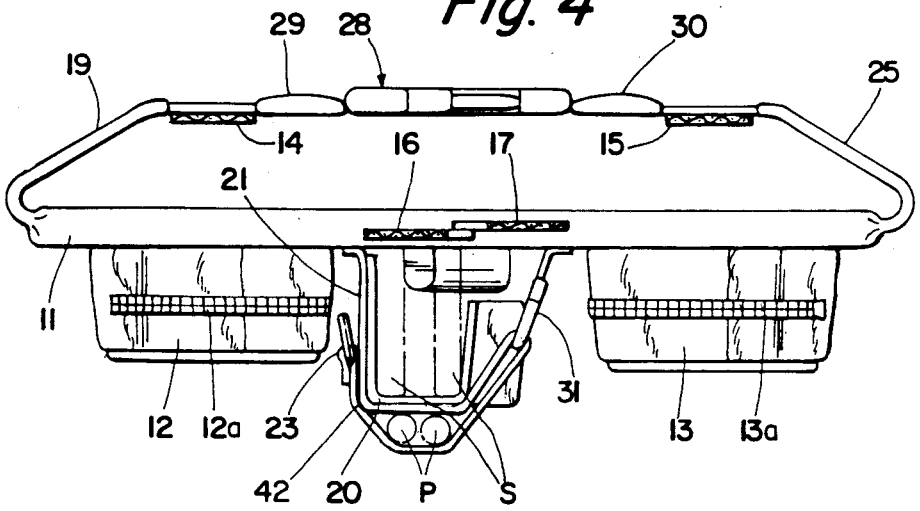

SKI AND POLE CARRIER

BACKGROUND-FIELD OF INVENTION

This invention relates to a ski and pole carrier worn by the skier, specifically to an improvement in which the carried objects are located below the small of the skier's back and the weight is carried on the hips rather than on the back or shoulders.

BACKGROUND-DESCRIPTION OF PRIOR ART

Skiers are normally faced with the awkward and burdensome problem of carrying skis, poles, gloves, goggles, and various other items. This task is complicated by the fact that the typical pair of skis is longer than the skier is tall, and, at an average of 14 pounds, too heavy to be carried comfortably by hand. Typically the skis and poles are strapped together, slung over one shoulder and stabilized by hand.

Inventors have created several types of ski equipment carrier which place the skis and poles at the skier's mid-back, rotated slightly with respect to the vertical axis. U.S. Pat. No. 4,308,982 to Hall (1982) discloses a carrier having a rigid support capable of stabilizing a pair of skis and poles and maintaining their alignment across the back. But this carrier is supported by a single strap worn over one shoulder, and must either be removed before skiing or continued to be worn with resulting increase in fatigue and decrease in safety. U.S. Pat. No. 4,518,107 to Amos (1985) discloses a non-rigid carrier supported by separate straps over each shoulder and further stabilized by a narrower strap about the waist. Though both arms are free and alignment of the skis is maintained, the weight is still carried on the shoulders, as with a backpack, increasing fatigue, and the soft nature of the carrier allows movement of the skis relative to the body. Additionally, the arrangement of retaining straps and placement of the skis places the upper portion of the skis directly behind the neck and base of the skull.

OBJECTS AND ADVANTAGES

Accordingly, several objects and advantages of the present invention are:

(1) to provide a carrier in which the weight of skis, poles and ski accessories is carried on the hips, reducing fatigue;

(2) to provide a carrier having a rigid ski and pole support to prevent movement of the skis with respect to the skier's body;

(3) to provide a carrier in which the center of moment of the skis is located below the small of the back, improving stability and comfort;

(4) to provide a carrier which can be comfortably worn while skiing;

(5) to provide a carrier having pockets in which to carry all ski accessories;

(6) to provide a carrier which is comfortable to wear, and which allows ski equipment to be transported safely and with relative freedom of movement of the skier.

Still further objects and advantages will become apparent from a consideration of the following description and drawings.

DRAWING FIGURES

FIG. 3 is a rear view of the ski and pole carrier showing details of its component parts;

FIG. 4 is a top view of the carrier system along cut line 4—4 of FIG. 3;

REFERENCE NUMERALS IN DRAWING

Figure 1:
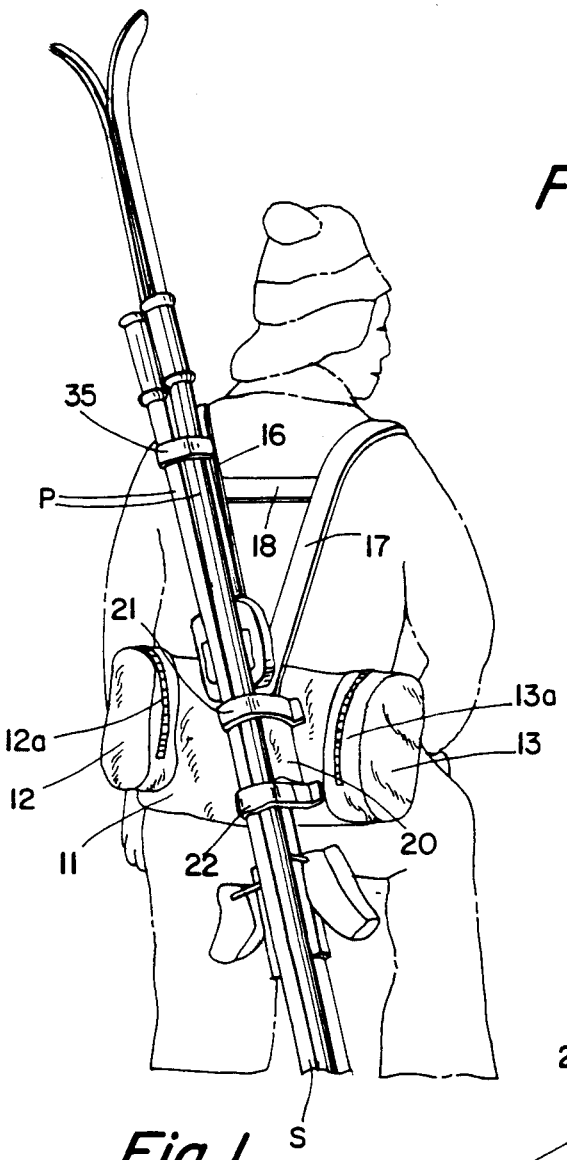
FIG. 1 is a pictorial view showing a skier carrying a pair of skis and poles in an oblique vertical position on the user's hips by means of the ski and pole carrier of FIG. 3.

10 Cover—hip cutaway
11 Cover
12 Left pocket
**12*a*** Left pocket closure
13 Right pocket
**13*a*** Right pocket closure
14 Left shoulder strap—lower
15 Right shoulder strap—lower
16 Left shoulder strap—upper
17 Right shoulder strap—upper
18 Cross brace strap
19 Waist belt—left half
20 Locator flap
21 Upper guide strap
22 Lower guide strap
23 Upper guide strap D-ring
24 Lower guide strap D-ring
25 Waist belt—right half
26 Body pad
**26*a*** Guide slot
**26*b*** Base recess
27 Locator base
**27*a*** Locator guide
**27*b*** Locator separator
28 Waist belt release
29 Left waist belt bar slide
30 Right waist belt bar slide
31 Upper guide strap release
32 Lower guide strap release
33 Left shoulder strap release
34 Right shoulder strap release
35 Alignment strap
36 Alignment strap D-ring
37 Right shoulder strap slide bar
38 Left shoulder strap slide bar
39 Alternate locator base
40 Alternate locator guide
41 Alternate locator seperator
42 Guide strap fastener
43 Alignment strap fastener

DESCRIPTION

A typical embodiment of the improved ski and pole carrier of the present invention is shown in FIG. 1. The skier is able to carry his skis, poles and all ski accessories; his hands and arms are free to move; and he can continue to wear the carrier while he skis.

The essential components of the carrier are the wide belt for distributing the weight of the hips (cover 11), the shoulder harness (straps 14–18), the means for carrying the skis and poles and for aligning them with one shoulder (locator 27, body pad 26, guide straps 21, 22), and the means for securing skis and poles near one shoulder to restrict side-to-side and forward-backward movement of the skis and poles and reduce fatigue (alignment strap 35). One or more pockets 12, 13 for carrying ski accessories can be attached as desired to the wide belt.

Figure 2:
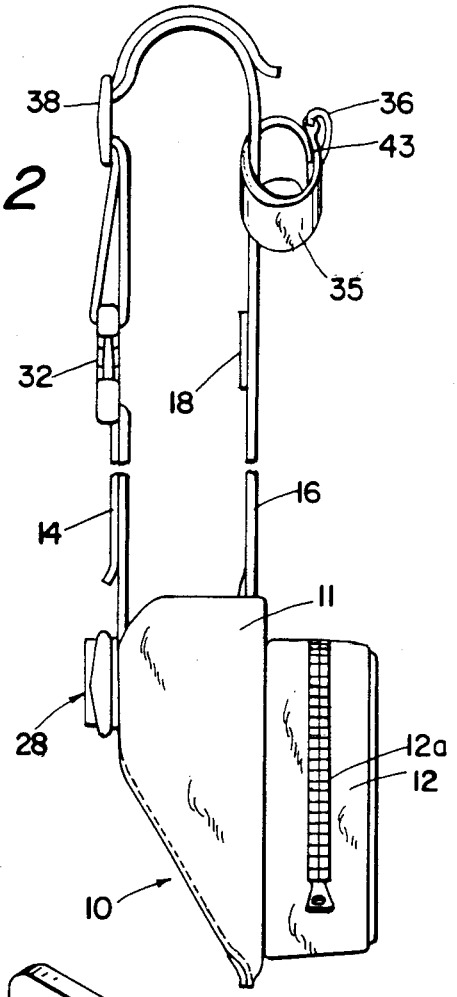
FIG. 2 is a left-side view of the carrier system of FIG. 3.
Figure 5:
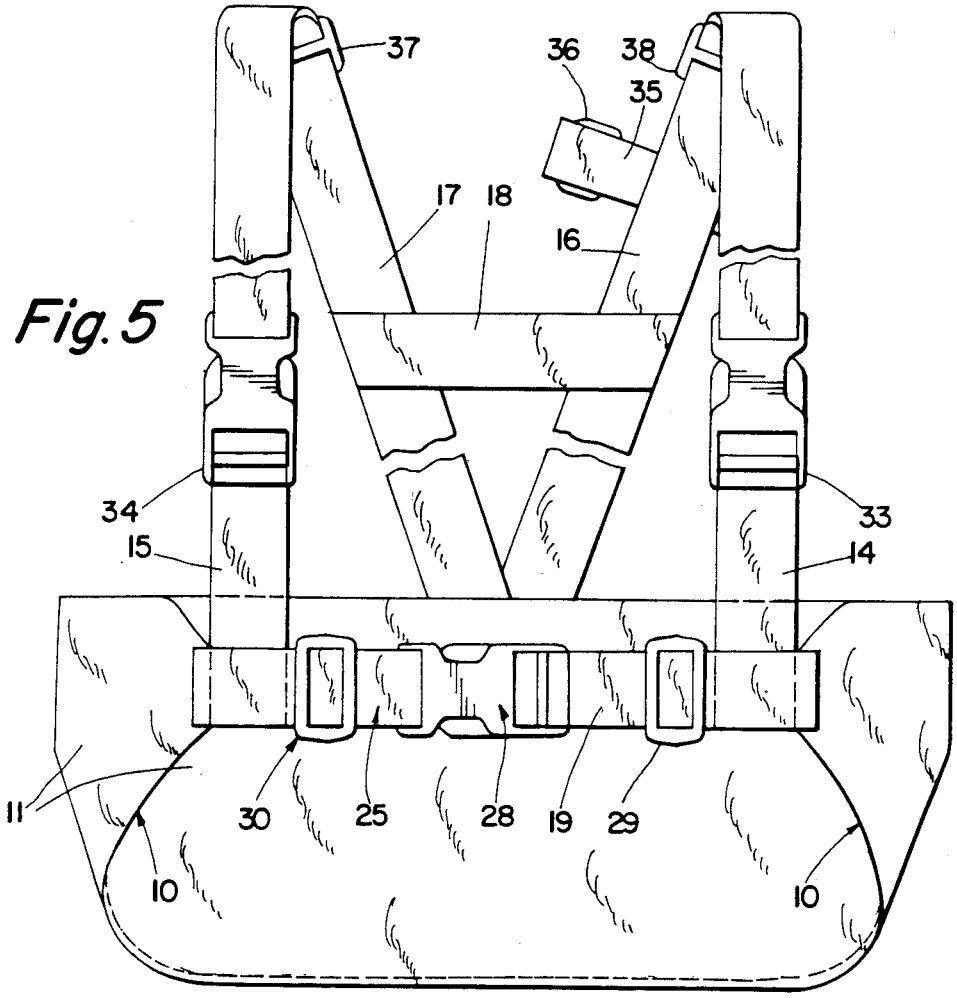
FIG. 5 is a front view of the ski equipment carrier.

FIG. 2, FIG. 3, and FIG. 5 disclose how cover 11 is shaped so that hip cutaway 10 allows the cover to rest comfortably on the skier's hips, permitting locator 27 to be located just below the small of the back.

In the embodiment preferred at the time the application is filed, the means for carrying the skis and poles and for aligning these with one shoulder is implemented in location 27 working in conjunction with body pad 26, cover 11 and guide straps 21, 22.

Figure 6:
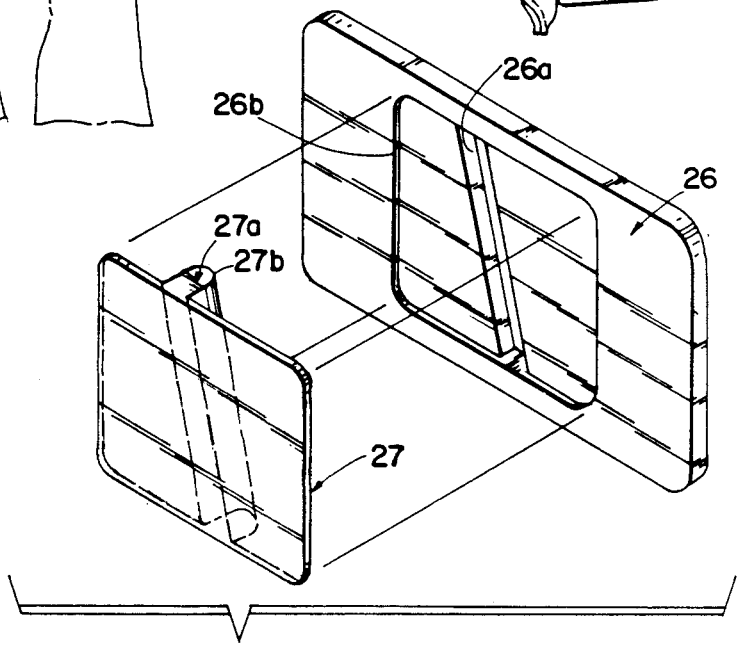
FIG. 6 is an isometric view of the ski locator and mounting detail in the body pad.
Figure 7:
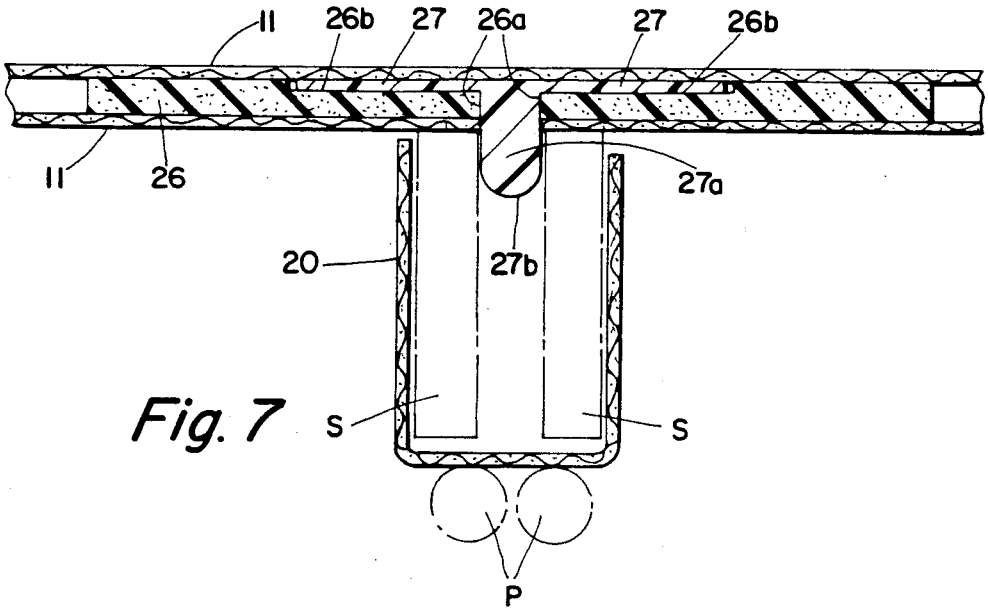
FIG. 7 is a bottom view through cut line 7—7 of FIG. 3 showing locator, body pad, cover, locator flap, and the outline of mounted skis and poles.

The preferred locator and the manner in which it cooperates with the body pad, cover, and guide straps is shown in FIG. 3, FIG. 6, and FIG. 7.

As shown in FIG. 6 the locator comprises a base 27, guide **27*a* and separator 27*b*. In the preferred embodiment the locator is molded as a single unit from a resilient plastic. Locator guide 27*a* is perpendicular to locator base 27 and is disposed at an angle of 20 degrees with respect to the vertical axis. The locator guide edge opposite the locator base is rounded and is called the locator separator 27*b***. Its function is to spread or separate the two skis as they are pushed onto the locator guide. Alternative implementations of the locator separator can comprise a shaped edge other than one which is rounded, e.g., triangular, trapazoidal, or elliptical, etc.

Figure 10:
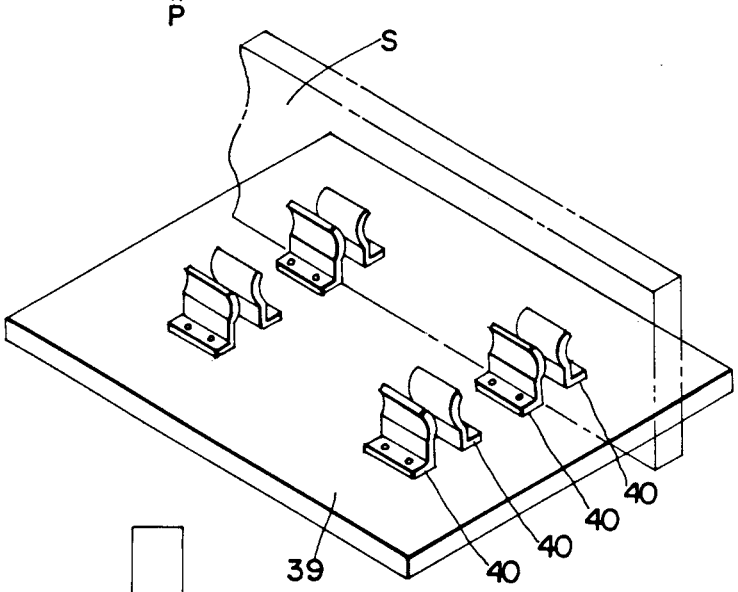
FIG. 10 is an isometric view of an alternative implementation of the locator using clip pairs with one ski in place.
Figure 11:
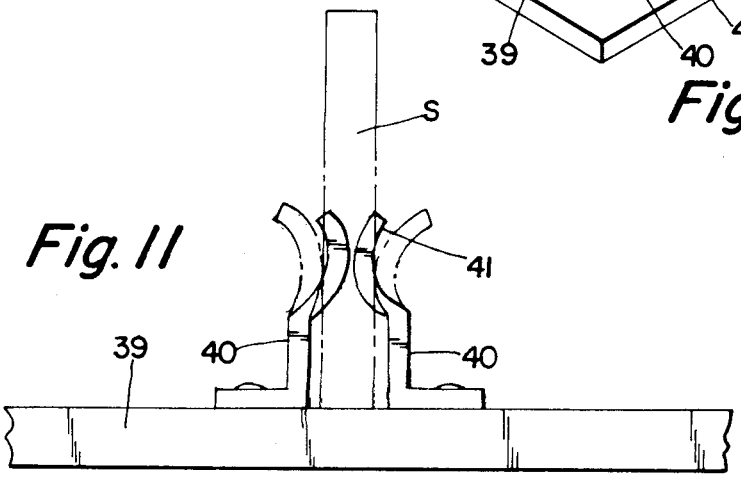
FIG. 11 is an end view of the alternative implementation of the locator showing detail of one clip both with ski engaged and without.

An alternative implementation of the locator is depicted in FIG. 10 and FIG. 11 in which paired clips 40 are used to support and align the skis. The separator function in this alternative is performed by the curved upper edge 41 of the clips 40.

In the preferred embodiment, body pad 26 is constructed of a flexible, foam-like material, and entirely fills the space inside cover 11. Body pad 26 serves several purposes in the present invention; it gives locator 27 a definite position within cover 11; it serves as a stiffener for cover 11; it assists in distributing the weight of skis and poles more uniformly across the hips; and it acts as a shock absorber between carried load and skier's body.

FIG. 6 shows details of how the locator 27 is mounted into the body pad 26. Locator base 27 fits within recess **26*b* of the body pad, and locator guide 27*a* extends through opening 26*a* in the body pad. FIG. 7 shows a view from the bottom edge of assembled locator 27, body pad 26, and cover 11. Locator guide 27*a* extends also through an opening in cover 11 so that it is available to support and align the skis and poles. FIG. 3 shows the assembled cover 11, body pad 26, and locator 27** as viewed in X-ray fashion from the rear.

As seen in FIG. 4, cover 11 is completed at the front by means of attached waist belt 19, 25 and waist belt release 28. In the preferred embodiment, waist belt release 28 comprises a side-release buckle for speed and ease of operation. Bar slides 29, 30 provide adjustment of the length of each half of the waist belt 19, 25.

The basic carrier is completed by attachment of the shoulder harness comprising shoulder straps 14–17 and brace 18. As shown from the rear in FIG. 3, shoulder straps 16, 17 attach to the top center of the cover (see also FIG. 4). And FIG. 5 shows the front (lower) portions of the shoulder straps 14, 15 attached to that portion of respective waist belt halves 19, 25 nearest the points where the latter attach to cover 11 (see also FIG. 4). The shoulder straps 16, 17 are each provided with bar slides 38, 37 to permit individual adjustment of the length of each shoulder strap. Each shoulder strap is provided with a release 33, 34, which in the preferred embodiment of the present invention are side-release buckles.

Figure 9:
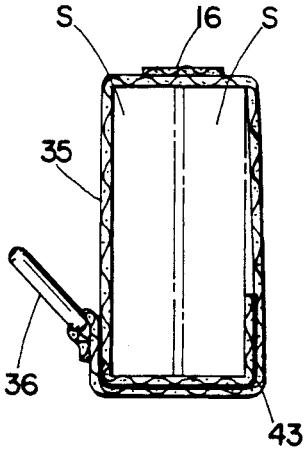
FIG. 9 shows detail of alignment strap, D-ring, and fastener from the perspective of cut line 9—9 of FIG. 3.

Alignment strap 35 is attached to one shoulder strap 16 as depicted in FIG. 3. The strap encircles the skis S (FIG. 9), or skis and poles P (FIG. 1), and is kept in the closed position by fastener 43, which, in the preferred embodiment, is made of Velcro (TM). Alignment strap D-ring 36 is provided to permit easy fastening and unfastening of alignment strap 35.

Figure 8:
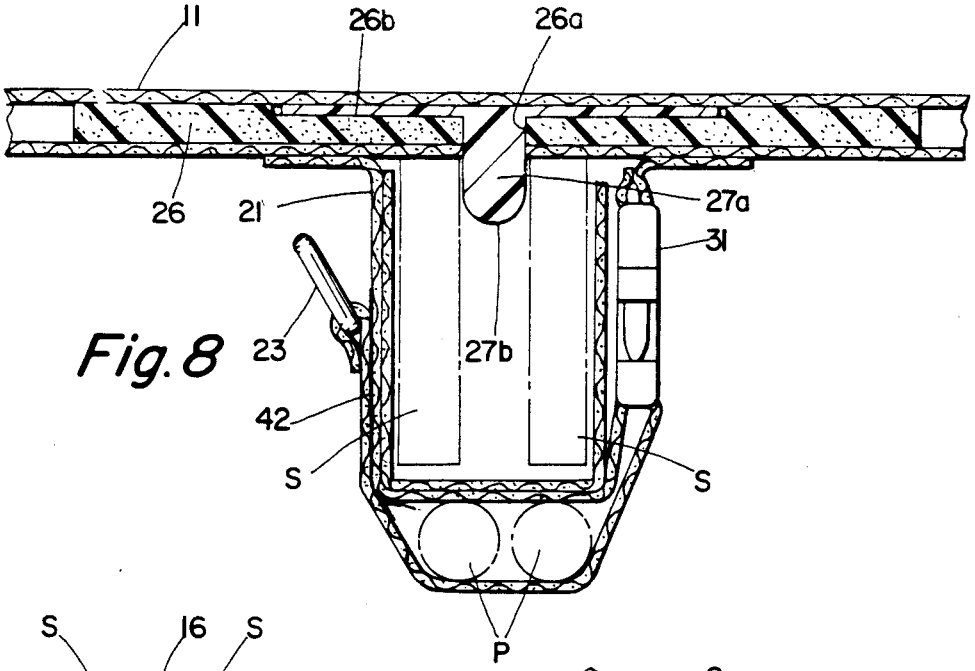
FIG. 8 is the same view as FIG. 7 showing details of the lower guide strap, D-ring, release, and fastener.

FIG. 8 shows details of the upper guide strap 21 and guide flap 20 (FIG. 7). Guide strap 21 is attached at one end to cover 11, body pad 26, and locator base 27. In the preferred embodiment this connection is made by means of rivets. In use (FIG. 8) guide strap 21 crosses over guide flap 20 and skis S which are supported by the locator guide **27*a* extending through an opening in cover 11. After crossing over the skis, guide strap 21 passes through one end of release 31 and returns back over the ski poles P and down adjacent to guide strap fastener 42 which in the preferred embodiment is made of Velcro (TM). Guide strap D-ring 23 permits easy fastening and unfastening of the strap. The other end of release 31 is attached to cover 11, body pad 26, and locator base 27 in the same manner as guide strap 21. The lower guide strap 22, release 32, fastener 42, and D-ring 24 are identical. Guide flap 20 (FIG. 7) is attached at its upper and lower ends to upper and lower guide straps 21, 22, respectively, near that portion of the straps adjacent to fastener 42**.

During use in transporting ski equipment, a pair of skis, arranged face-to-face and locked in position by the ski's binding brakes, is grasped and the skis are pressed onto locator guide **27*a* allowing locator separator 27*b* to separate the skis as they slide over the locator guide. Guide flap 20 is then wrapped across the skis, the forward bindings of which are positioned slightly above upper guide strap 21, and upper and lower guide strap release 31, 32 are manually engaged. The ski poles are then laid along the skis on top of guide flap 20 as shown in FIG. 1, FIG. 4, and the skier grasps each guide strap by its D-ring 23, 24, one at a time, and pulls each guide strap taut against its corresponding release. Next the skier presses each guide strap down against its Velcro (TM) fastener 42. Finally, the skier encircles both skis and poles with alignment strap 35, grasps its D-ring 36, pulls the strap taut, and presses it down against its Velcro (TM) fastener 43. Ski accessories can be placed into pockets 12, 13 and the pockets closed by means of their respective closures 12*a*, 13*a*** without removing the carrier.

Finally, the skier slips his arms through shoulder straps 14–17 and fastens waist belt release 28.

What is claimed is:

1. An apparatus for carrying objects on a person below the small of the back of the person, said apparatus comprising: a padded belt which encircles the waist of the person, wherein said belt distributes the weight of said objects to the hips of the person, said belt having inner and outer sides, an inner space, first and second ends, and an axis extending through said belt and passing through said ends; a pair of shoulder straps attached to said belt; a base firmly attached to said belt and located within said inner space; a support for skis rigidly mounted on said base and disposed at an angle with respect to said axis, said support having means which projects through said outer side of said belt for aligning and guiding skis with respect to said support; means for fastening ski poles and skis to said base and said support.

2. The device in claim 1 wherein the means for aligning and guiding the skis with respect to the ski support includes a shaped, ski-separating edge.

3. The device described in claim 1 further comprising means located on one of said shoulder straps for maintaining alignment of the skis and poles with said one of the shoulder straps.

* * * * *